US007886550B2

(12) United States Patent
Tamura et al.

(10) Patent No.: US 7,886,550 B2
(45) Date of Patent: Feb. 15, 2011

(54) REFRIGERATING MACHINE

(75) Inventors: Tomoichiro Tamura, Kyoto (JP); Masaya Honma, Osaka (JP); Kou Komori, Nara (JP); Tetsuya Saito, Yamaguchi (JP)

(73) Assignee: Panasonic Corporation, Osaka (JP)

( * ) Notice: Subject to any disclaimer, the term of this patent is extended or adjusted under 35 U.S.C. 154(b) by 406 days.

(21) Appl. No.: 11/913,400

(22) PCT Filed: Apr. 27, 2006

(86) PCT No.: PCT/JP2006/308875

§ 371 (c)(1),
(2), (4) Date: Nov. 1, 2007

(87) PCT Pub. No.: WO2006/120922

PCT Pub. Date: Nov. 16, 2006

(65) Prior Publication Data

US 2009/0031738 A1 Feb. 5, 2009

(30) Foreign Application Priority Data

May 6, 2005 (JP) ..... 2005-135060

(51) Int. Cl.
*F25B 49/00* (2006.01)

(52) U.S. Cl. ..... 62/197; 62/225

(58) Field of Classification Search ..... 62/222, 62/216, 197, 217, 225, 87, 116, 402
See application file for complete search history.

(56) References Cited

U.S. PATENT DOCUMENTS 2,434,593 A * 1/1948 Schulz et al. ..... 62/205
3,934,424 A * 1/1976 Goldsberry ..... 62/87
5,140,828 A * 8/1992 Hagita et al. ..... 62/222
5,224,354 A * 7/1993 Ito et al. ..... 62/210
6,272,871 B1 * 8/2001 Eisenhour ..... 62/225
6,595,024 B1 * 7/2003 Tang et al. ..... 62/498
6,662,576 B1 * 12/2003 Bai ..... 62/117

(Continued)

FOREIGN PATENT DOCUMENTS

JP 59-21461 2/1984

(Continued)

OTHER PUBLICATIONS

International Preliminary Report on Patentability issued Nov. 15, 2007 in the International (PCT) Application No. PCT/JP2006/308875.

(Continued)

*Primary Examiner*—George Nguyen
(74) *Attorney, Agent, or Firm*—Wenderoth, Lind & Ponack, L.L.P.

(57) ABSTRACT

A refrigerating machine includes a compressor for compressing a refrigerant, a radiator for radiating heat from the refrigerant discharged from the compressor, an expander for expanding the refrigerant discharged from the radiator, and an evaporator for evaporating the refrigerant discharged from the expander, all connected in series. The refrigerating machine also includes a refrigerant flow regulator for regulating the amount of refrigerant flowing into the expander and a controller for controlling the compressor and the refrigerant flow regulator. When the compressor is stopped, the controller controls the refrigerant flow regulator to reduce the amount of refrigerant flowing into the expander.

5 Claims, 9 Drawing Sheets

U.S. PATENT DOCUMENTS

| | | | | |
|---|---|---|---|---|
| 6,913,076 | B1 * | 7/2005 | Hays | 165/274 |
| 2004/0055318 | A1 * | 3/2004 | Hirota | 62/222 |
| 2005/0274133 | A1 * | 12/2005 | Barsanti | 62/225 |
| 2007/0151266 | A1 * | 7/2007 | Yakumaru et al. | 62/197 |
| 2008/0289344 | A1 * | 11/2008 | Bonte et al. | 62/114 |

FOREIGN PATENT DOCUMENTS

| | | |
|---|---|---|
| JP | 6-46260 | 6/1994 |
| JP | 7-19678 | 1/1995 |
| JP | 7-41359 | 7/1995 |
| JP | 11-132577 | 5/1999 |
| JP | 2000-329416 | 11/2000 |
| JP | 2001-116371 | 4/2001 |

OTHER PUBLICATIONS

International Search Report issued Aug. 8, 2006 in the International (PCT) Application PCT/JP2006/308875.

* cited by examiner

REFRIGERATING MACHINE

TECHNICAL FIELD

The present invention relates to a refrigerating machine for effectively recovering energy that is generated with expansion of a refrigerant.

BACKGROUND ART

In recent years, a power recovery cycle has been proposed having an expander in place of an expansion valve in order to further enhance the efficiency of a refrigerating machine. In this power recovery cycle, the expander acts to recover, when a refrigerant expands, expansion energy in the form of electric power or mechanical power, thereby reducing the input of a compressor by the amount of energy being recovered (see, for example, patent document 1).

FIG. 10 depicts the conventional refrigerating machine as disclosed in the patent document 1. The compressor 1 is driven by a drive means (not shown) such as, for example, an electric motor or an automobile engine to suck and compress the refrigerant. A high-temperature and high-pressure refrigerant discharged from the compressor 1 is cooled by a radiator 2, which in turn discharges the refrigerant towards an expander 3 in which the refrigerant is reduced in pressure and expands accordingly. The expander 3 then converts expansion energy of the refrigerant into mechanical energy (rotational energy) so that the mechanical energy (rotational energy) so converted may be supplied to a generator 4 for generation of electric power. The refrigerant that has been reduced in pressure and has expanded in the expander 3 evaporates in an evaporator 5 before it is again sucked into the compressor 1.

In this refrigerating machine, because the expander 3 reduces the pressure of the refrigerant while doing expansion work by converting expansion energy into mechanical energy, the refrigerant discharged from the radiator 2 reduces enthalpy while undergoing a phase change along an isentropic curve (c→d), as shown in FIG. 11. Accordingly, as compared with a case in which during a pressure reduction, the refrigerant merely undergoes adiabatic expansion without doing any expansion work (an isenthalpic change), the phase change along the isentropic curve can increase a difference in specific enthalpy between an inlet side and an outlet side of the evaporator 5 by an amount corresponding to expansion work Δiexp, making it possible to increase the refrigerating capacity. Also, because mechanical energy (rotational energy) can be supplied to the generator 4 by the expansion work Δiexp, the generator 4 can generate electric power (Δiexp×power generation efficiency), which is in turn supplied to the compressor 1. As such, electric power required for driving the compressor 1 can be reduced and, hence, the coefficient of performance (COP) of the refrigerating cycle can be enhanced.

Patent document 1: Japanese Laid-Open Patent Publication No. 2000-329416

However, when the compressor 1 is held at a standstill, the refrigerant moves from the side of the radiator 2 towards the side of the evaporator 5 due to a pressure difference created in the refrigerating cycle during operation of the compressor 1. Accordingly, in the conventional construction referred to above, the refrigerant that has moved from the side of the radiator 2 flows into the expander 3 and is brought into contact with oil contained in an oil sump within the expander 3. When the expander 3 is held at a standstill, the oil sump contains a lot of oil and, in particular under low-temperature conditions, a lot of refrigerant dissolves in the oil. As such, when the refrigerating machine is started again, it runs short of the proper amount of flow of the refrigerant. Also, the viscosity of the oil in the expander 3 lowers due to the presence of a lot of refrigerant dissolving in the oil.

If the amount of flow of the refrigerant is insufficient, the refrigerant pressure in the evaporator 5 lowers and, hence, the temperature of pipes and fins disposed within the evaporator 5 also lowers. When this temperature becomes less than 0° C., frost may be formed on such pipes and fins within the evaporator 5. Accordingly, the resistance to flow in the evaporator 5 increases and, at worst, there is a possibility of the evaporator 5 clogging. If the evaporator 5 clogs, the amount of air flowing though the evaporator 5 greatly reduces, and the amount of heat-exchange is extremely reduced. As a result, the compressor 1 sucks and compresses a liquid refrigerant in the evaporator 5, and there arises a possibility of the compressor 1 being damaged. Further, the lowering of the viscosity of the oil in the expander 3 may cause damage to the sliding surfaces of the expander 3, which in turn causes a reduction in reliability of the expander 3.

SUMMARY OF THE INVENTION

The present invention has been developed to overcome the above-described disadvantages. It is accordingly an objective of the present invention to realize a steady start-up of the refrigerating machine by reducing the amount of refrigerant flowing into a shell of the expander during a stop of the compressor to thereby reduce the amount of refrigerant that may dissolve in the oil within the shell of the expander.

In accomplishing the above objective, a refrigerating machine according to the present invention includes a compressor operable to compress a refrigerant, a radiator operable to radiate heat from the refrigerant discharged from the compressor, an expander operable to expand the refrigerant discharged from the radiator, and an evaporator operable to evaporate the refrigerant discharged from the expander. The compressor, the radiator, the expander, and the evaporator are connected in series. The refrigerating machine further includes a refrigerant flow regulator operable to regulate an amount of flow of the refrigerant that flows into the expander and a controller operable to control the compressor and the refrigerant flow regulator. At a stop of the compressor, the controller controls the refrigerant flow regulator to reduce an amount of refrigerant flowing into the expander.

EFFECTS OF THE INVENTION

The refrigerating machine according to the present invention can realize a steady start-up thereof by reducing, at the stop of the compressor, the amount of refrigerant flowing into the expander and reducing the amount of refrigerant that dissolves in oil in the expander.

EXPLANATION OF REFERENCE NUMERALS

Figure 1:
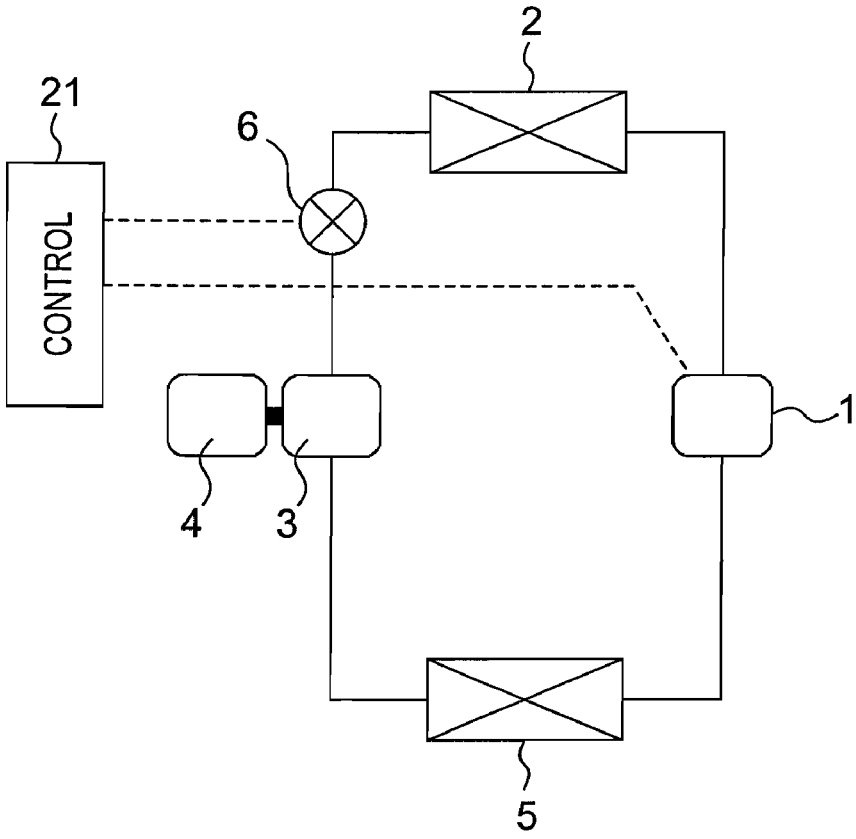
FIG. 1 is a block diagram of a refrigerating machine according to a first embodiment of the present invention.

1 compressor
2 radiator
3 expander
4 generator
5 evaporator
6 on-off valve
7 bypass circuit
8 on-off valve
9 three-way valve
10 bypass circuit
11 first on-off valve
12 second on-off valve
13 bypass circuit
14 detector for detecting discharge temperature of compressor
15 on-off valve
16 detector for detecting room temperature
17 detector for detecting internal temperature of machine
21, 22, 23, 24 controller

DETAILED DESCRIPTION OF THE INVENTION

Embodiments of the present invention are explained hereinafter with reference to the drawings.

Embodiment 1

FIG. 1 is a block diagram of a refrigerating machine according to a first embodiment of the present invention, wherein component parts identical with those in the prior art are designated by identical reference numerals.

As shown in FIG. 1, the refrigerating machine according to the first embodiment of the present invention includes a compressor 1, a radiator 2, an on-off valve 6, an expander 3 for recovering expansion energy of a refrigerant, and an evaporator 5, all connected in series by piping to define a refrigerating cycle. Carbon dioxide is filled as the refrigerant in the refrigerating machine. This refrigerating machine also includes a controller 21 for controlling the compressor 1 and the on-off valve 6. The on-off valve 6 serves as a refrigerant flow regulating means for regulating the amount of flow of the refrigerant that flows into the expander 3. In this embodiment, a high internal pressure type expander is employed as the expander 3.

The expander 3 acts to convert expansion energy of the refrigerant into mechanical energy (rotational energy), and the mechanical energy (rotational energy) so converted is supplied to a generator 4 for generation of electric power, which is in turn utilized to drive the compressor 1 or the like.

Figure 11:
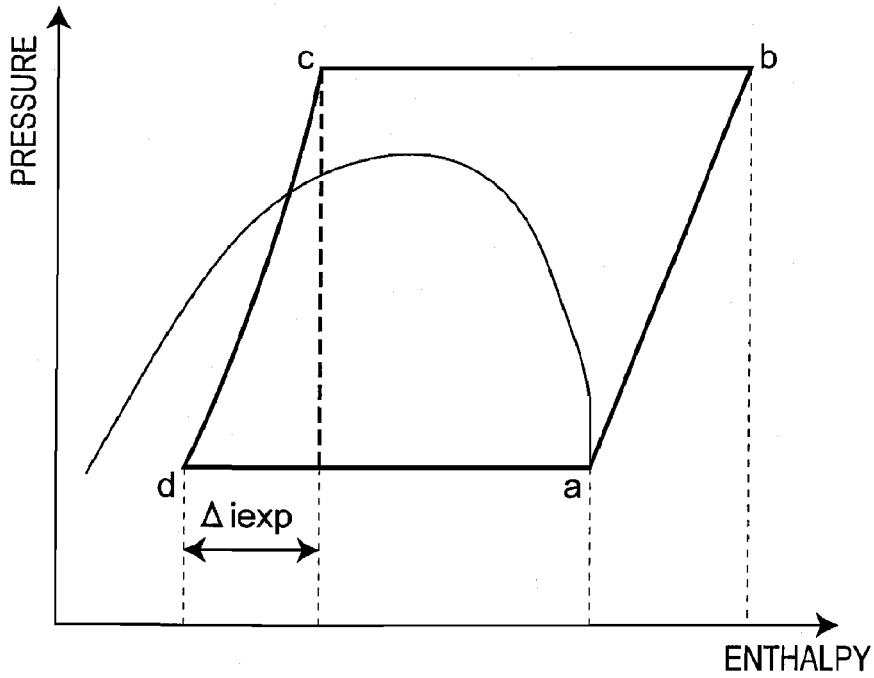
Fig.11 PRIOR ART
FIG. 11 is a Mollier diagram of the refrigerating machine.

Taking the case in which the refrigerating machine with the above-described construction is applied to a water heater for home use, a change in energy conditions of the refrigerant during normal operation is explained hereinafter with reference to a Mollier diagram as shown in FIG. 11.

A low-temperature and low-pressure refrigerant is compressed by the compressor 1 and discharged therefrom in the form of a high-temperature and high-pressure refrigerant (a→b). The refrigerant discharged from the compressor 1 heat-exchanges with tap water in the radiator 2 and heats the tap water up to a high-temperature of about 80° C. before the refrigerant is led into the expander 3 (b→c). In the expander 3, the refrigerant undergoes isentropic expansion and is reduced in pressure while generating mechanical energy before the refrigerant reaches the evaporator 5. At this moment, the on-off valve 6 is kept fully opened by the controller 21 (c→d). Thereafter, the refrigerant heat-exchanges with outside air in the evaporator 5 and turns into a gaseous refrigerant, which is in turn sucked into the compressor 1 via a suction pipe (d→a).

Where the radiator 2 is used as a heating source for a room heater, a vending machine, or the like as well as a water heater by making use of the above-described phase change of the refrigerant, electric power generated by the generator 4 can be utilized to drive the compressor 1. Accordingly, as compared with a conventional refrigerating machine in which the refrigerant undergoes isenthalpic expansion in an expansion valve or a capillary tube, the power for the compressor 1 can be reduced, making it possible to enhance the efficiency.

Also, where the evaporator 5 is used as a cooling source for a refrigerator for home use, a refrigerator for official use, a cooler, an ice making machine, a vending machine, or the like, electric power generated by the generator 4 can be utilized to drive the compressor 1. Accordingly, as compared with the conventional refrigerating machine in which the refrigerant undergoes isenthalpic expansion in the expansion valve or the capillary tube, not only can the power for the compressor 1 be reduced, but the refrigerating effect (a difference in specific enthalpy of the refrigerant between an inlet side and an outlet side of the evaporator 5) also increases, making it possible to further enhance the efficiency.

Further, because the first embodiment utilizes carbon dioxide as the refrigerant, a difference between the high pressure and the low pressure in the refrigerating cycle becomes large, as compared with a refrigerating cycle employing an HFC refrigerant. Accordingly, the amount of energy recovered by the expander 3 can be increased, resulting in a large energy-saving effect.

A control method at a stop of the compressor 1 is explained hereinafter.

Irrespective of the use of the refrigerating machine, when a user has selected to stop the refrigerating machine, a stop signal of the refrigerating machine is inputted to the controller 21, which in turn stops the compressor 1 and closes the on-off valve 6. The closure of the on-off valve 6 can block the refrigerant flowing into the expander 3 from the side of the radiator 2 after the stop of the compressor 1. Also, the use of a high internal pressure type expander as the expander 3 can reduce the amount of refrigerant flowing into the expander 3 from the side of the evaporator 5.

An example of the high internal pressure type expander is explained hereinafter with reference to FIG. 2.

Figure 2:
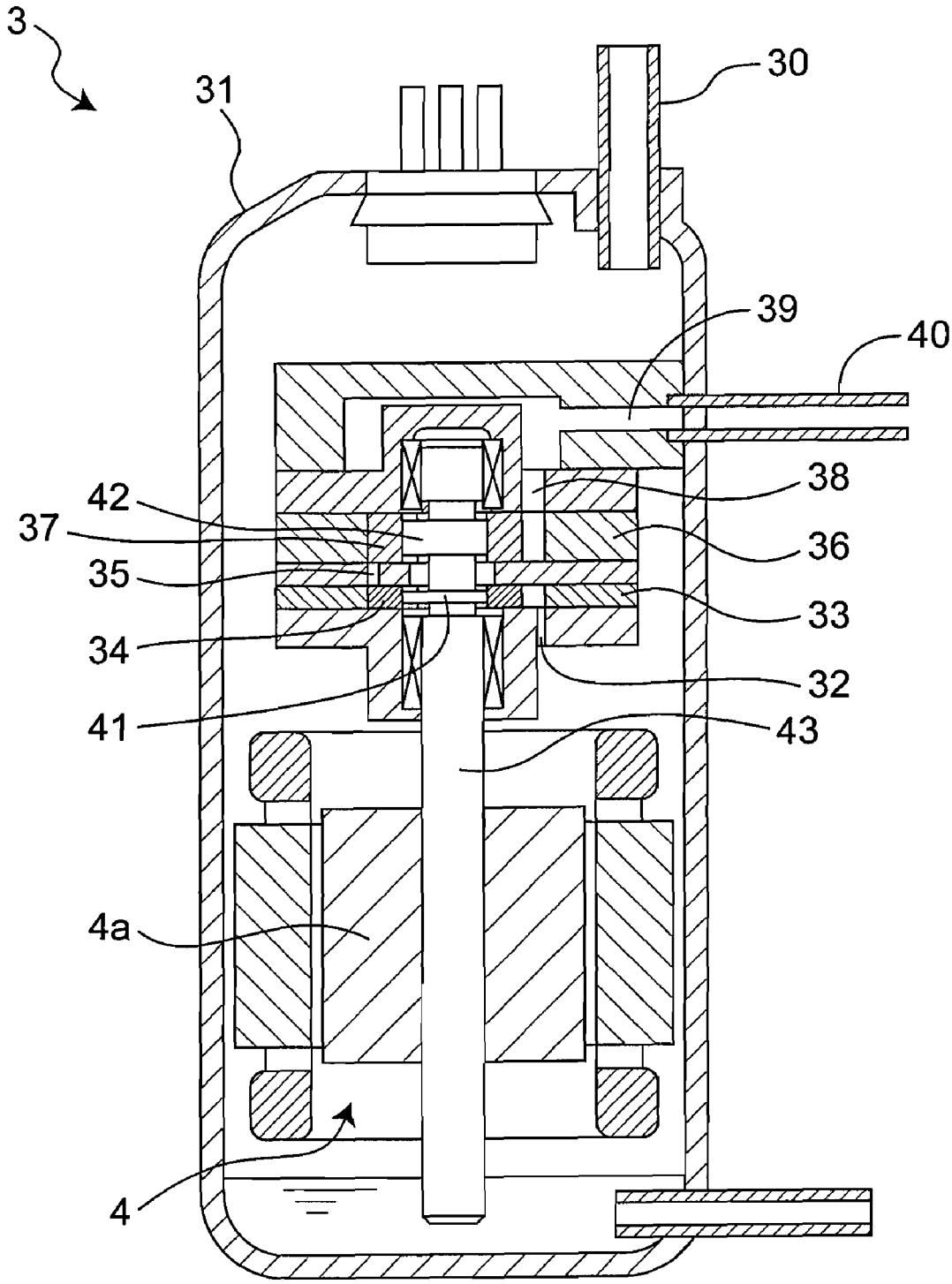
FIG. 2 is a vertical sectional view of an expander of a high internal pressure type that is used in the refrigerating machine of FIG. 1.

As shown in FIG. 2, in the high internal pressure type expander, a high-pressure refrigerant is sucked into a closed vessel 31 through an inlet pipe 30. The high-pressure refrigerant flows into a first cylinder 33 through a suction port 32 and expands within the first cylinder 33. At this moment, an expansion force of the refrigerant rotates a first roller 34. The refrigerant that has expanded within the first cylinder 33 flows into a second cylinder 36 through a communication hole 35 and further expands within the second cylinder 36. At this moment, an expansion force of the refrigerant rotates a second roller 37. A low-pressure refrigerant that has expanded within the second cylinder 36 is discharged through a discharge port 38 and another discharge port 39 and then through an outlet pipe 40.

When the first roller 34 and the second roller 37 rotate in the manner as described above, a first eccentric portion 41 within the first roller 34 and a second eccentric portion 42 within the second roller 37 rotate, followed by rotation of a shaft 43. As a result, a rotor 4*a* of the generator 4 rotates to generate electric power. That is, expansion energy of the refrigerant is recovered in the form of electric power.

In the case of the high internal pressure type expander with the above-described construction, the closed vessel 31 is filled with the high-pressure refrigerant, and the outlet pipe 40 that communicates with the evaporator 5 is almost separated from the high-pressure refrigerant in terms of the mechanism of the expander. Accordingly, at a stop of the compressor 1, the amount of refrigerant flowing into the expander 3 can be reduced by controlling the on-off valve 6 to close it, making it possible to prevent a shortage of the amount of flow of the refrigerant at the restarting of the refrigerating machine and also prevent damage to the sliding surfaces of the expander 3.

In particular, where the stop time of the refrigerating machine is long, the refrigerant dissolves in oil to such an extent that the latter is saturated with the refrigerant. Hence, the above-described effect becomes conspicuous when the refrigerating machine is kept stopped for a long time.

Because the compressor 1 stops instantaneously at the time the electric current is stopped, even if an operation order is given to the on-off valve 6 at the same time as a stop order is given to the compressor 1, it is unlikely that problems would occur in association with safety such as an abnormal increase of the discharge pressure of the compressor 1. Accordingly, it is preferred that the stop control of the compressor 1 and the closing control of the on-off valve 6 be carried out simultaneously. However, if the closing operation of the on-off valve 6 is started between when the supply of electric current to the compressor 1 is stopped and when the oil within the expander 3 is saturated with the refrigerant, the effect of reducing the amount of refrigerant that dissolves in the oil can be expected. For this reason, it is most preferable that a valve such as, for example, a solenoid valve that can be closed quickly be used as the on-off valve 6, but a valve such as, for example, an expansion valve that tends to close slowly can also be used.

Although in the above-described first embodiment the expander 3 converts expansion energy of the refrigerant into mechanical energy (rotational energy), which is in turn supplied to the generator 4 for generation of electric power, similar effects can be obtained by directly connecting the compressor 1 and the expander 3 via a shaft so that the expansion energy may be directly recovered as the mechanical energy (rotational energy).

Also, although in the first embodiment carbon dioxide is used as the refrigerant, it goes without saying that similar effects can be obtained with the use of a natural refrigerant other than carbon dioxide (for example, an ammonia refrigerant or an HC refrigerant) or an HFC refrigerant.

Figure 3:
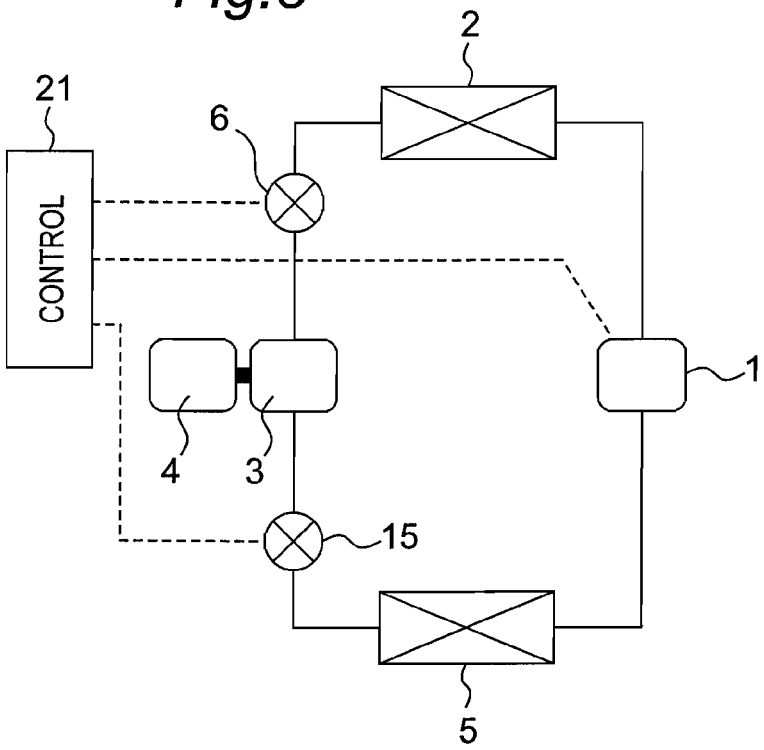
FIG. 3 is a block diagram of a modification of the refrigerating machine of FIG. 1.

Further, although in the first embodiment the amount of refrigerant that flows into the expander 3 from the evaporator 5 is reduced with the use of a high internal pressure type expander as the expander 3, an on-off valve 15 may be provided on the low pressure side of the expander 3, i.e., between the expander 3 and the evaporator 5, as shown in FIG. 3, to completely block the refrigerant flowing into the expander 3 by closing the two on-off valves 6, 15 positioned on both sides of the expander 3 at the time the compressor 1 is stopped.

In this invention, a low internal pressure type expander can be used as the expander 3. In the case of the low internal pressure type expander of a modified form of FIG. 2, the inlet pipe 30 and the first cylinder 33 are directly connected to each other, and a low-pressure refrigerant is discharged into the closed vessel 31 through the discharge port 39. Because of this, the closed vessel 31 is filled with the low-pressure refrigerant, and the inlet pipe 30 communicating with the radiator 2 is almost separated from the low-pressure refrigerant in terms of the mechanism of the expander. Accordingly, if an on-off valve 15 is provided between the expander 3 and the evaporator 5, the amount of refrigerant flowing into the expander 3 can be reduced by closing the on-off valves 15 at the time the compressor 1 is stopped, making it possible to avoid a shortage in the amount of circulation of the refrigerant at the time of restarting the refrigerating machine or damage to the sliding surfaces of the expander.

It also will be understood that even with the use of the low internal pressure type expander, if an on-off valve 6 is additionally provided on the high pressure side of the expander 3, i.e., between the expander 3 and the radiator 2, as shown in FIG. 3, the refrigerant flowing into the expander 3 can be completely blocked by closing the two on-off valves 6, 15 positioned on both sides of the expander 3 at the time of stop of the compressor 1.

Although in the first embodiment the compressor 1 has been described as being stopped when the user has selected to stop the refrigerating machine, the compressor 1 may be stopped based on a control rule thereof. By way of example, in the case of a room heater, the compressor 1 is stopped when a room temperature detector has detected a temperature greater than a set temperature.

Embodiment 2

Figure 4:
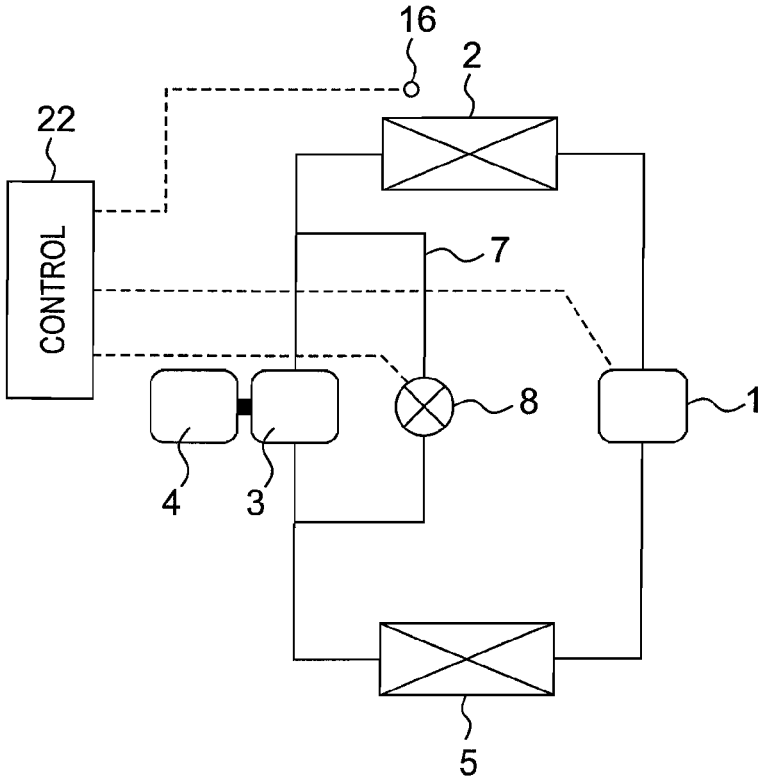
FIG. 4 is a block diagram of a refrigerating machine according to a second embodiment of the present invention.

FIG. 4 is a block diagram of a refrigerating machine according to a second embodiment of the present invention, wherein component parts identical with those in the prior art are designated by identical reference numerals. Also, explanation of the component parts common to those of FIG. 1 is omitted.

In FIG. 4, the refrigerating machine includes a compressor 1 for compressing a refrigerant, a radiator 2 for radiating heat from the refrigerant discharged from the compressor 1, an expander 3 for recovering expansion energy of the refrigerant, and an evaporator 5 for evaporating the refrigerant discharged from the expander 3, all connected in series by piping. The refrigerating machine also includes a bypass circuit 7 for bypassing the expander 3 and an on-off valve 8 provided in the bypass circuit 7, both employed as a refrigerant flow regulating means for regulating the amount of flow of the refrigerant that flows into the expander 3. Carbon dioxide is filled as the refrigerant in the refrigerating machine.

Figure 5:
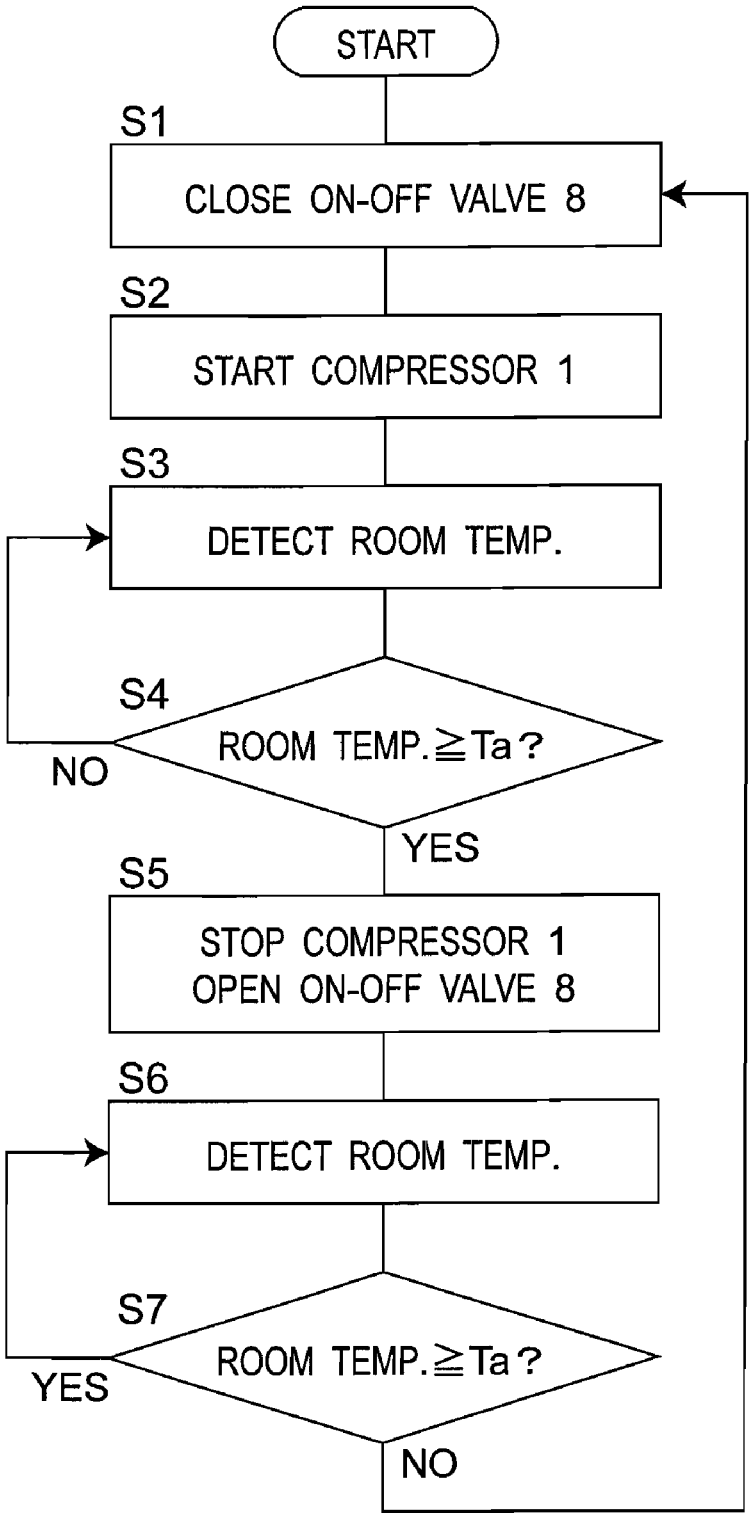
FIG. 5 is a flowchart showing a control of the refrigerating machine according to the second embodiment of the present invention.

A control method at the time of the compressor 1 is stopped is explained hereinafter with reference to a control flowchart of FIG. 5.

In the case of a room heater, for example, the on-off valve 8 is kept closed at step S1, followed by step S2, at which a controller 22 starts the compressor 1. At step S3, a room temperature detector (ambient temperature detector) 16 attached in proximity to the radiator 2 detects a room temperature, and at step S4, the room temperature detected by the room temperature detector 16 is compared with a set temperature Ta. If the detected room temperature is judged to be less than the set temperature Ta, the program returns to step S3, while If the detected room temperature is judged to be greater than or equal to the set temperature Ta, the program advances to step S5, at which point the controller 22 stops the compressor 1 to regulate the heating capacity of the radiator 2 disposed inside the room. At almost the same time, the controller 22 controls the on-off valve 8 to open it.

Because a circuit on the side of the expander 3 has a large resistance to flow compared with the bypass circuit 7, the refrigerant preferentially flows through the bypass circuit 7. That is, a small amount of refrigerant flows into the expander 3, and most of the refrigerant flows through the bypass circuit 7, thereby reducing the amount of refrigerant flowing into the expander 3, reducing the radiating side pressure, and enhancing the safety of the refrigerating machine. At step S6, the room temperature detector 16 detects the room temperature, and at step S7, the room temperature detected by the room temperature detector 16 is compared with the set temperature Ta. If the detected room temperature is judged to be greater than or equal to the set temperature Ta, the program returns to step S6, while If the detected room temperature is judged to be less than the set temperature Ta, the program returns to step S1, at which point the controller 22 controls the on-off valve 8 to close it.

By the above-described construction, where the refrigerating machine is used as the room heater, even if the compressor 1 repeatedly starts and stops to bring the room temperature close to the set temperature, a shortage of the amount of circulation of the refrigerant at the time of restarting the refrigerating machine or damage of the sliding surfaces of the expander 3 can be avoided. Also, because the above-described construction can maintain the optimum amount of circulation of the refrigerant, a reduction in efficiency of the refrigerating machine can be avoided, and energy savings can be attained, as compared with conventional machines.

Although in the second embodiment referred to above, the compressor 1 has been explained as being stopped when the room temperature detector 16 has detected a temperature greater than or equal to the set temperature Ta, the compressor 1 may be stopped when the user has selected to stop the refrigerating machine.

Embodiment 3

Figure 6:
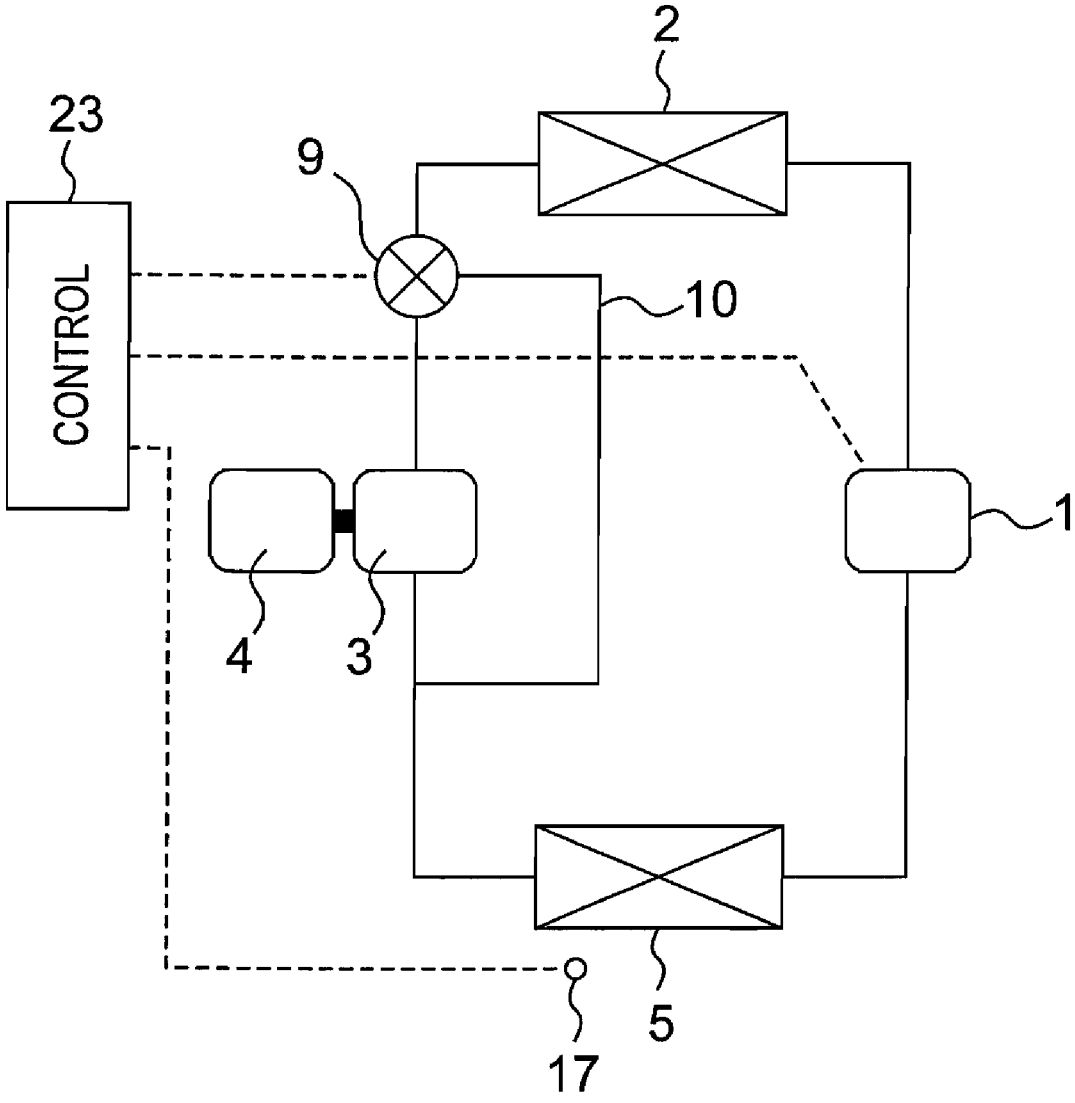
FIG. 6 is a block diagram of a refrigerating machine according to a third embodiment of the present invention.

FIG. 6 is a block diagram of a refrigerating machine according to a third embodiment of the present invention, wherein component parts identical with those in the prior art are designated by identical reference numerals. Also, explanation of the component parts common to those of FIG. 1 is omitted.

In FIG. 6, the refrigerating machine includes a compressor 1 for compressing a refrigerant, a radiator 2 for radiating heat from the refrigerant discharged from the compressor 1, an expander 3 for recovering expansion energy of the refrigerant, and an evaporator 5 for evaporating the refrigerant discharged from the expander 3, all connected in series by piping. The refrigerating machine also includes a bypass circuit 10 for bypassing the expander 3 and a three-way valve 9 for switching between a passage leading to the bypass circuit 10 and another passage leading to the expander 3, both employed as a refrigerant flow regulating means for regulating the amount of flow of the refrigerant that flows into the expander 3. Carbon dioxide is filled as the refrigerant in the refrigerating machine.

Figure 7:
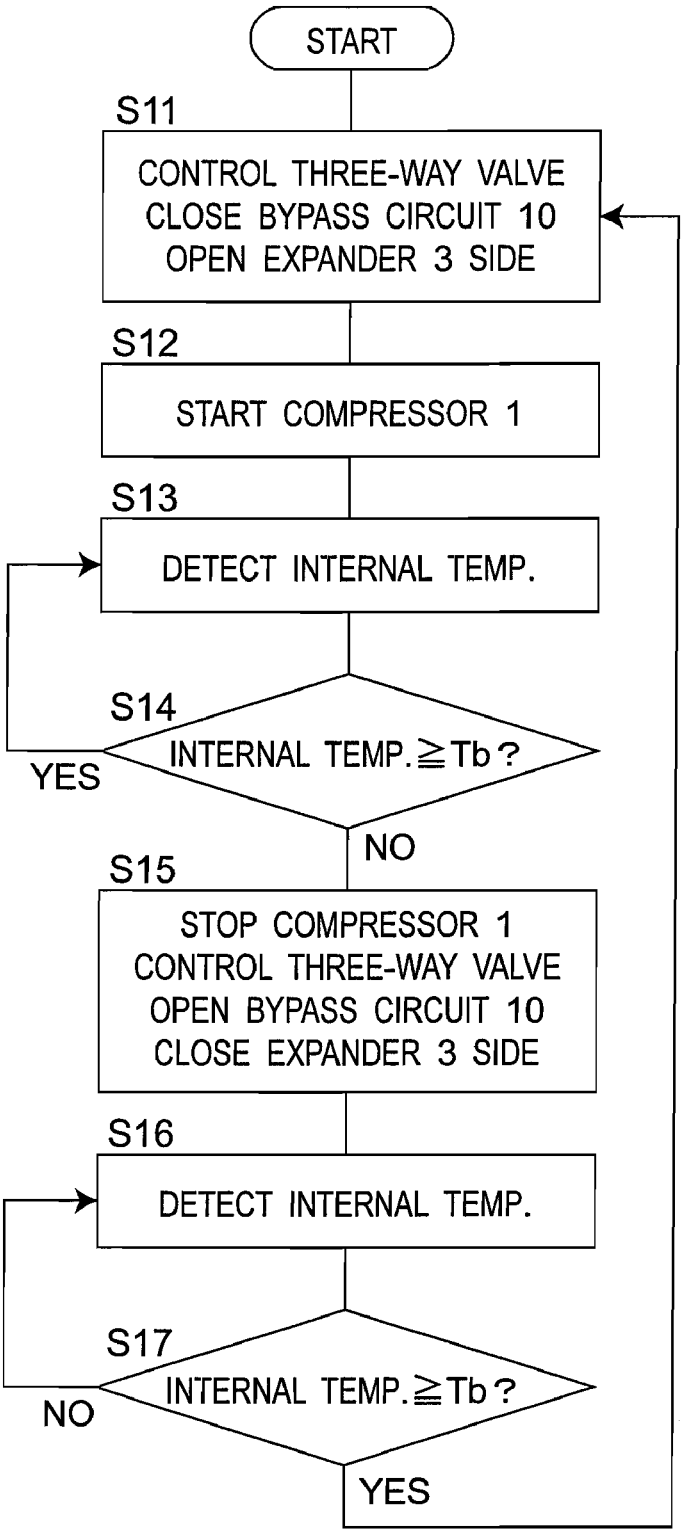
FIG. 7 is a flowchart showing a control of the refrigerating machine according to the third embodiment of the present invention.

A control method at the time the compressor 1 is stopped is explained hereinafter with reference to a control flowchart of FIG. 7.

In the case of a refrigerator, for example, the three-way valve 9 is controlled at step S11 to close the passage on the side of the bypass circuit 10 and open the passage on the side of the expander 3, and at step S12, a controller 23 starts the compressor 1. At step S13, an internal temperature detector (ambient temperature detector) 17 attached in proximity to the evaporator 5 detects an internal temperature, and at step S14, the internal temperature detected by the internal temperature detector 17 is compared with a set temperature Tb. If the detected internal temperature is judged to be greater than or equal to the set temperature Tb, the program returns to step S13. If the detected internal temperature is judged to be less than the set temperature Tb, the program advances to step S15, at which point the controller 23 stops the compressor 1 to regulate the cooling capacity of the evaporator 5 disposed inside the refrigerator. At almost the same time, the controller 23 controls the three-way valve 9 to open the passage on the side of the bypass circuit 10 and close the passage on the side of the expander 3.

In this way, at the time the compressor 1 is stopped, the controller 23 controls the three-way valve 9 to close the passage on the side of the expander 3 and flow the refrigerant through the bypass circuit 10. By so doing, the refrigerant flowing into the expander 3 is blocked at the time the compressor 1 is stopped, thereby considerably reducing the amount of refrigerant that dissolves in an oil in the expander 3, reducing the evaporator side pressure, and enhancing the safety of the refrigerating machine.

At step S16, the internal temperature detector 17 detects the internal temperature, and at step S17, the internal temperature detected by the internal temperature detector 17 is compared with the set temperature Tb. If the detected internal temperature is judged to be less than the set temperature Tb, the program returns to step S16, while If the detected internal temperature is judged to be greater than or equal to the set temperature Tb, the program returns to step S11, at which the controller 23 controls the three-way valve 9.

Accordingly, when the refrigerating machine is used as the refrigerator, even if the compressor 1 repeatedly starts and stops to bring the internal temperature close to the set temperature, a shortage of the amount of circulation of the refrigerant at the time of restarting the refrigerating machine or damage of the sliding surfaces of the expander 3 can be avoided.

Although in the third embodiment referred to above, the internal temperature is detected, an evaporating temperature detector for detecting an evaporating temperature of the refrigerant in the evaporator 5 can be used in place of the internal temperature detector.

Also, although in the third embodiment the compressor 1 has been explained as being stopped when the internal temperature detector has detected a temperature less than the set temperature, the compressor 1 may be stopped when the user has selected a stop of the refrigerating machine.

Embodiment 4

Figure 8:
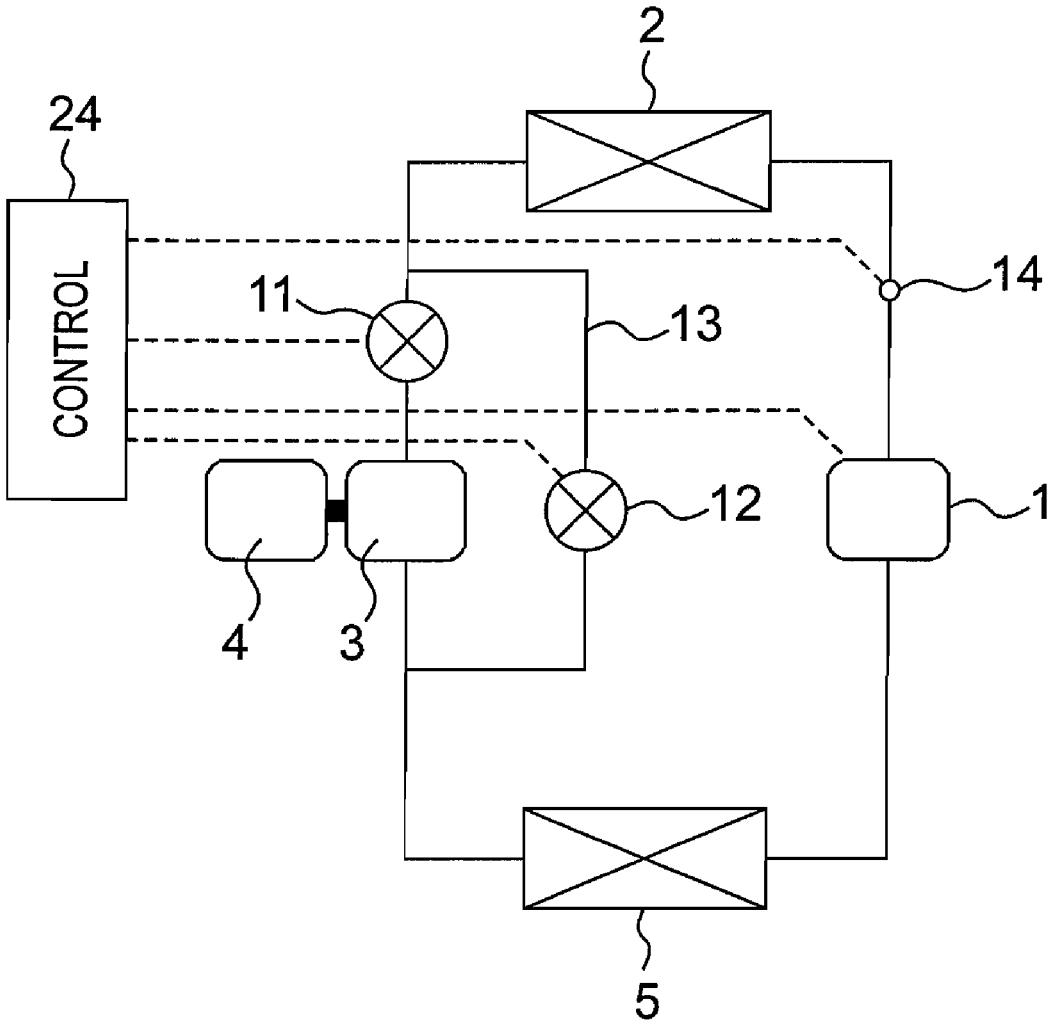
FIG. 8 is a block diagram of a refrigerating machine according to a fourth embodiment of the present invention.

FIG. 8 is a block diagram of a refrigerating machine according to a fourth embodiment of the present invention, wherein component parts identical with those in the prior art are designated by identical reference numerals. Also, explanation of the component parts common to those of FIG. 1 is omitted.

In FIG. 8, the refrigerating machine includes a compressor 1 for compressing a refrigerant, a radiator 2 for radiating heat from the refrigerant discharged from the compressor 1, a first on-off valve 11, an expander 3 for recovering expansion energy of the refrigerant, and an evaporator 5 for evaporating the refrigerant discharged from the expander 3, all connected in series by piping. The refrigerating machine also includes a bypass circuit 13 for bypassing the expander 3 and a second on-off valve 12 provided in the bypass circuit 7. In this embodiment, the first on-off valve 11, the second on-off valve 12, and the bypass circuit 13 serves as a refrigerant flow regulating means for regulating the amount of flow of the refrigerant that flows into the expander 3. In addition, a discharge temperature detector 14 is provided between the compressor 1 and the radiator 2 to detect a discharge temperature of the compressor 1. Carbon dioxide is filled as the refrigerant in the refrigerating machine.

Figure 9:
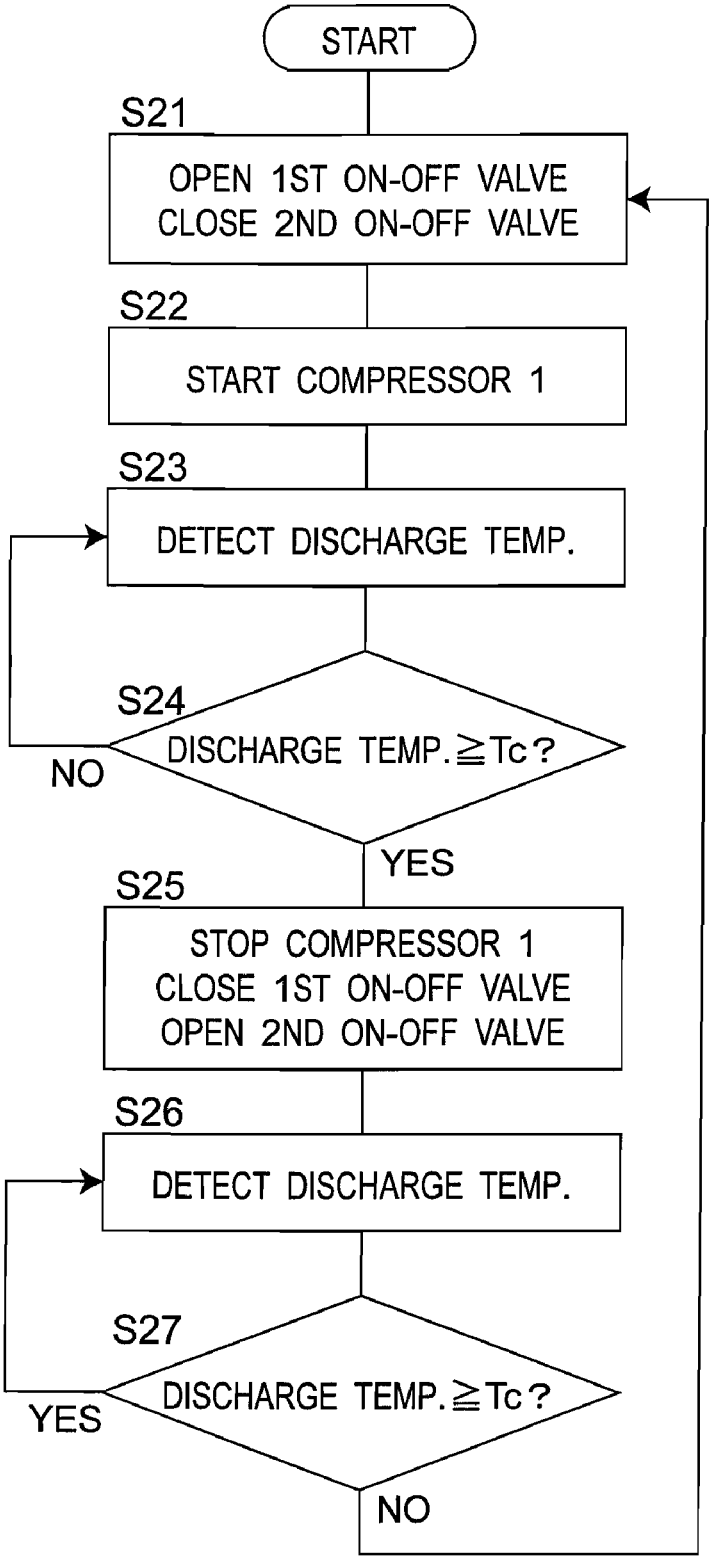
FIG. 9 is a flowchart showing a control of the refrigerating machine according to the fourth embodiment of the present invention.
Figure 10:
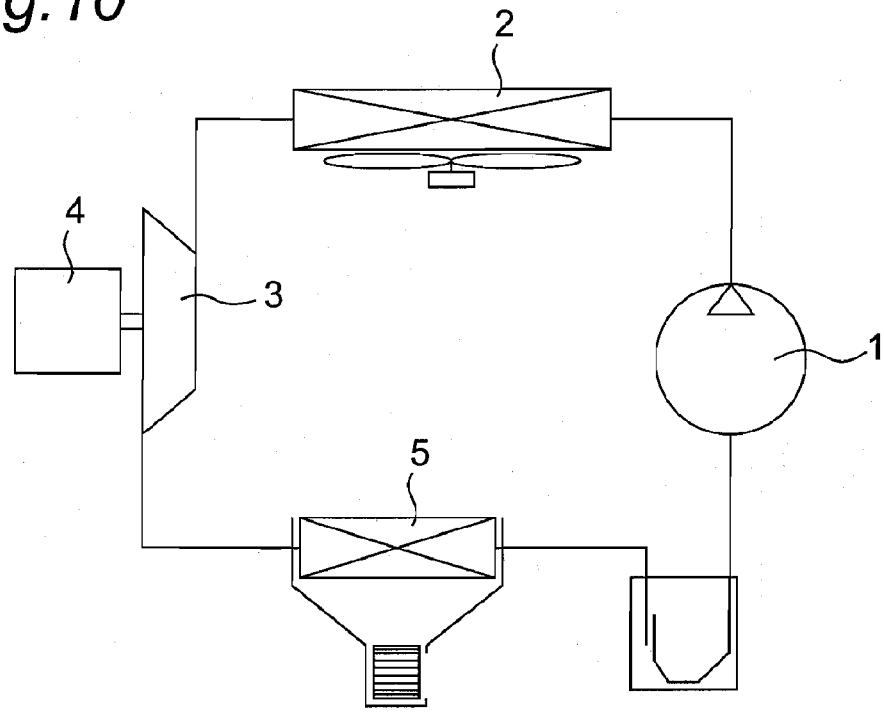
FIG. 10 is a block diagram of a conventional refrigerating machine.

A control method at the time the compressor 1 is stopped is explained hereinafter with reference to a control flowchart of FIG. 9.

The first on-off valve 11 is kept opened and the second on-off valve 12 is kept closed at step S21, followed by step S22, at which a controller 24 starts the compressor 1. At step S23, the discharge temperature detector 14 detects the discharge temperature of the compressor 1, and at step S24, the discharge temperature detected by the discharge temperature detector 14 is compared with a set temperature Tc. If the detected discharge temperature is judged to be less than the set temperature Tc, the program returns to step S23. If the detected discharge temperature is judged to be greater than or equal to the set temperature Tc, the program advances to step S25, at which point the controller 24 stops the compressor 1 for protection thereof. At almost the same time, the controller 24 controls the two on-off valves 11, 12 to close the first on-off valve 11 and open the second on-off valve 12.

As a result, the refrigerant flowing into the expander 3 is blocked and the refrigerant flows through the bypass circuit 13 before it enters the evaporator 5. Accordingly, the refrigerant flowing into the expander 3 is blocked at the time the compressor 1 is stopped, thereby considerably reducing the amount of refrigerant that dissolves in oil in the expander 3, as compared with conventional machines.

At step S26, the discharge temperature detector 14 detects the discharge temperature, and at step S27, the discharge temperature detected by the discharge temperature detector 14 is compared with the set temperature Tc. If the detected discharge temperature is judged to be greater than or equal to the set temperature Tc, the program returns to step S26. If the detected discharge temperature is judged to be less than the set temperature Tc, the program returns to step S21, at which point the controller 24 controls the first on-off valve 11 and the second on-off valve 12.

By the above-described construction, even if the refrigerating machine has conducted a protection control for the compressor 1, a shortage of the amount of circulation of the refrigerant at the time of restarting the refrigerating machine or damage of the sliding surfaces of the expander 3 can be avoided.

Although in the fourth embodiment referred to above the compressor 1 has been explained as being stopped when the discharge temperature detector 14 has detected a temperature greater than or equal to the set temperature, the compressor 1 may be stopped when the user has selected a stop of the refrigerating machine.

Further, although in the fourth embodiment the compressor 1 and the first and second on-off valves 11, 12 have been described as being controlled based on the discharge temperature of the compressor 1 detected by the discharge temperature detector 14 that is provided between the compressor 1 and the radiator 2, a discharge pressure detector may be provided between the compressor 1 and the radiator 2 in place of the discharge temperature detector 14 so that the compressor 1 and the first and second on-off valves 11, 12 can be controlled based on a discharge pressure detected by the discharge pressure detector 14.

In addition, the amount of refrigerant flowing into the expander 3 is reduced depending on the room temperature detected by the room temperature detector 16 in the second embodiment, on the internal temperature detected by the internal temperature detector 17 in the third embodiment, and on the discharge temperature of the compressor 1 detected by the discharge temperature detector 14 or the discharge pressure of the compressor 1 detected by the discharge pressure detector in the fourth embodiment. Not only can each of these detectors be applied to any one of the second to fourth embodiments, but the amount of refrigerant flowing into the expander 3 can also be reduced using a plurality of detectors.

INDUSTRIAL APPLICABILITY

As described above, the refrigerating machine according to the present invention can reduce the amount of refrigerant that enters the expander and dissolves in oil at the time the compressor is stopped, as compared with conventional machines, and a shortage of the amount of circulation of the refrigerant at the time of restarting the compressor or damage of the sliding surfaces of the expander can be avoided. Accordingly, the refrigerating machine according to the present invention is widely applicable to various equipment such as, for example, water heaters, air conditioners, vending machines, refrigerators for home use, refrigerators for official use, freezers, ice making machines, and the like.

The invention claimed is:

1. A refrigerating machine comprising:

a compressor operable to compress a refrigerant;

a radiator operable to radiate heat from the refrigerant discharged from the compressor;

a high internal pressure type expander operable to expand the refrigerant discharged from the radiator;

an evaporator operable to evaporate the refrigerant discharged from the expander;

the compressor, the radiator, the expander, and the evaporator being connected in series;

a refrigerant flow regulator operable to regulate an amount of flow of the refrigerant that flows into the expander, the refrigerant flow regulator comprising an on-off valve disposed between an upstream side of the expander and a downstream side of the radiator; and a controller operable to control the compressor and the refrigerant flow regulator, the controller being configured to:

maintain the on-off valve in a fully open position during normal operation of the compressor; and close the on-off valve when operation of the compressor has stopped, thereby reducing an amount of refrigerant flowing into the expander.

2. The refrigerating machine according to claim 1, wherein the on-off valve is a first on-off valve, the refrigerant flow regulator further comprising a second on-off valve disposed between an upstream side of the evaporator and a downstream side of the expander, and wherein the controller is configured to close the second on-off valve when operation of the compressor has stopped.

3. The refrigerating machine according to claim 1, wherein the compressor, the radiator, the expander, the evaporator, and the on-off valve are connected in series.

4. A refrigerating machine comprising:

a compressor operable to compress a refrigerant;

a radiator operable to radiate heat from the refrigerant discharged from the compressor;

a low internal pressure type expander operable to expand the refrigerant discharged from the radiator;

an evaporator operable to evaporate the refrigerant discharged from the expander;

the compressor, the radiator, the expander, and the evaporator being connected in series;

a refrigerant flow regulator operable to regulate an amount of flow of the refrigerant that flows into the expander, the refrigerant flow regulator comprising an on-off valve disposed between a downstream side of the expander and an upstream side of the evaporator; and a controller operable to control the compressor and the refrigerant flow regulator, the controller being configured to:

maintain the on-off valve in a fully open position during normal operation of the compressor; and close the on-off valve when operation of the compressor has stopped, thereby reducing an amount of refrigerant flowing into the expander.

5. The refrigerating machine according to claim 4, wherein the compressor, the radiator, the expander, the evaporator, and the on-off valve are connected in series.

* * * * *